US007134843B2

(12) United States Patent
Lardellier

(10) Patent No.: US 7,134,843 B2
(45) Date of Patent: Nov. 14, 2006

(54) TURBINE WHEEL FOR TURBOMACHINE AND THE ASSEMBLY METHOD FOR SUCH A WHEEL

(75) Inventor: Alain Lardellier, Melun (FR)

(73) Assignee: Snecma Moteurs, Paris (FR)

( * ) Notice: Subject to any disclaimer, the term of this patent is extended or adjusted under 35 U.S.C. 154(b) by 126 days.

(21) Appl. No.: 10/937,426

(22) Filed: Sep. 10, 2004

(65) Prior Publication Data

US 2005/0106019 A1 May 19, 2005

(30) Foreign Application Priority Data

Sep. 19, 2003 (FR) ..... 03 50579

(51) Int. Cl.
*F01D 5/30* (2006.01)

(52) U.S. Cl. ..... 416/204 R; 416/214 R

(58) Field of Classification Search ..... 415/115; 416/97 R, 204 R, 214 R, 216, 219 R, 220 R, 416/221, 222
See application file for complete search history.

(56) References Cited

U.S. PATENT DOCUMENTS 819,106 A * 5/1906 Wilkinson ..... 416/217
2,401,826 A 6/1946 Halford
2,857,132 A 10/1958 McDowall
3,281,116 A * 10/1966 Keenan ..... 416/217
4,415,310 A * 11/1983 Bouiller et al. ..... 416/95
5,174,720 A * 12/1992 Gradl ..... 416/204 A

FOREIGN PATENT DOCUMENTS

DE 1 247 335 8/1967

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A turbine wheel for a turbomachine, the disk of which comprises upstream and downstream ribs extending in the annular direction around an axis, each blade segment installed on the disk being retained by the disk in an external radial direction using upstream engagement part forming part of the segment root and cooperating with complementary upstream engagement part forming an external radial end of the upstream rib, and downstream engagement part forming part of the root and capable of cooperating with complementary downstream engagement part forming an external radial end of the downstream rib. Furthermore, the upstream and downstream ribs are movable from a separated engagement position to a close position, and vice versa, so that each blade segment can be assembled on the turbine disk.

23 Claims, 7 Drawing Sheets

TURBINE WHEEL FOR TURBOMACHINE AND THE ASSEMBLY METHOD FOR SUCH A WHEEL

TECHNICAL DOMAIN

This invention generally relates to a turbine wheel for a turbomachine, of the type comprising a turbine disk and several blade segments installed on this turbine disk.

Furthermore, the invention also relates to an assembly method for such a turbine wheel.

STATE OF PRIOR ART

Conventionally, as known in prior art, a turbine wheel for a turbomachine comprises a turbine disk and several blades installed on the turbine disk, each blade comprising a root extending from a radially inner profile, and being provided with retaining shapes known as <<ribbed fittings>>.

To assemble the blades on a turbine disk, the turbine disk is usually provided with a series of approximately axial grooves opened radially towards the outside, with a shape complementary to the shape of the above mentioned <<ribbed fittings>>, and in which the blades may be inserted one after the other, to be held in place by this turbine disk.

Although this solution is very widespread in turbines in existing turbomachines, it thus has a number of serious disadvantages.

Firstly, note that the roots of the blades and the complementary shapes (or teeth) of the turbine disk are necessarily relatively voluminous, in order to ensure that these elements are held firmly in place with respect to each other, despite high radial forces generated during rotation of the turbine wheel. Naturally, these large volumes directly result in weight constraints and material cost constraints. Note also that the complex production of <<ribbed>> shapes of blades and the disk causes non-negligible manufacturing costs.

Furthermore, with this type of solution according to prior art, it is obvious that a given root cannot support a large number of blades, and the number of blades is usually less than or equal to two. This is particularly due to the fact that if there are more blades on the same root, the root and the notch necessary to insert these blades in the disk would then have to be longer and/or thicker. In this case, it is obvious that the mass of the <<blades-disk>> assembly increases unacceptably considering the relative advantage of reducing manufacturing costs.

In this respect, and as occurs in prior art, the fact that it is impossible to make segments fitted with a significant number of blades, and therefore to design long segments in the circumferential direction, is a major disadvantage. As the circumferential length of blade segments reduces, the number of segments installed around the turbine disk increases and the number of spaces to be sealed between two directly consecutive segments increases.

Moreover, this type of embodiment does not enable a satisfactory seal between firstly the turbine disk and secondly the blade segments. It is usually necessary to add an upstream labyrinth connected by a flanges system to the turbine disk. The upstream labyrinth can thus act as an axial stop for turbine blades in their fittings, protect the blades cooling circuit from unwanted crossovers of hot gases originating from the turbine stream which could pass through the turbine wheel through the clearance between the disk and the blades. The addition of the upstream labyrinth according to known art significantly reduces the passage of cooling air between the turbine disk and the blade segments, due to its participation in the creation of an intermediate chamber on the upstream to supply cooling air to the blades.

However, the required upstream labyrinth is a large part with a high mass and is extremely complicated to make, such that its presence is a very serious disadvantage, particularly in terms of extra cost.

OBJECT OF THE INVENTION

Therefore, the purpose of the invention is to propose a turbine wheel for a turbomachine with a turbine disk and several blade segments installed on this turbine disk, at least partially overcoming the disadvantages mentioned above related to embodiments according to prior art.

Another purpose of the invention is to present an assembly method for such a turbine wheel.

To achieve this, the first object of the invention is a turbine wheel for a turbomachine comprising a turbine disk and several blade segments fitted on this turbine disk, each blade segment comprising a root and at least one blade fixed to the root. The turbine disk comprises an upstream rib and a downstream rib, each extending approximately in the annular direction around a longitudinal principal axis of the wheel and radially as far as a radial end of the disk, each blade segment installed on the turbine disk possibly being retained by the turbine disk in an external radial direction using upstream engagement means forming part of the root and capable of cooperating with complementary upstream engagement means forming an external radial end of the upstream rib, and downstream engagement means also forming part of the root and capable of cooperating with complementary downstream engagement means forming an external radial end of the downstream rib. Moreover, the upstream and downstream ribs of the turbine disk are designed so that they can be moved from a separated engagement position to a close position, and vice versa, so that each blade segment can be assembled on the turbine disk. According to the invention, at least either the upstream rib or the downstream rib is designed elastically such that these ribs can be moved from the separated position to the close position and from the close position to the separated position by respectively applying a pressure on the ribs, and releasing the applied pressure.

Advantageously, the special design of the turbine wheel according to the invention is such that blade segments are assembled on the turbine disk particularly by simply bringing the upstream and downstream ribs towards each other so that these segments can be put into place. Effectively, the turbine disk is advantageously defined such that when the upstream and downstream ribs are in their close position, the complementary upstream and downstream engagement means are sufficiently far from the position that they occupy when the upstream and downstream ribs are in the separated engagement position, so that segments can be installed by inserting each blade segment and the turbine disk into each other.

In other words, in the close position, the complementary upstream and downstream engagement means are sufficiently close so that when the blade segments are inserted in the turbine disk by radial displacement of the segments inwards into the wheel, they do not form a stop for the upstream and downstream engagement means on the segment roots. Consequently, each blade segment can be freely moved in the radial direction with respect to the turbine disk, without being hindered by the complementary upstream and downstream engagement means which are further downstream than the upstream engagement means of the blade segments, and further upstream than the downstream engagement means of the same segments, respectively.

Furthermore, once all blade segments have been put into place on the turbine disk, the upstream and downstream ribs can once against be brought into their separated engagement position, in which the complementary upstream and downstream engagement means are then capable of performing their prime function, namely working in combination with the upstream and downstream engagement means to retain each blade segment in the radially outwards direction from the turbine disk.

In this respect, note that the turbine wheel according to the invention is such that assembly of blade segments on the turbine disk can be completed as soon as the upstream and downstream ribs are brought into their separated engagement position after having been brought close, or include later additional operations as will be described in detail below.

In the first case in which assembly of segments is terminated when the upstream and downstream ribs are brought into their separated engagement position, the configuration of the different engagement means may be such that simple displacement of the upstream and downstream ribs into their separated engagement position, causes automatic engagement of these engagement means. In other words, once the upstream and downstream ribs occupy their separated engagement position, the upstream and downstream engagement means of the blade segments cooperate with the complementary upstream and downstream engagement means respectively of the turbine disk, and therefore blade segments are automatically blocked in the external radial direction with respect to the disk. It should be noted that this configuration may be obtained particularly by providing engagement means not only blocking blade segments in the external radial direction, but also blocking these segments in the internal radial direction with respect to the turbine disk. This prevents upstream and downstream engagement means of some of these blade segments from disengaging from the complementary upstream and downstream engagement means by gravity. Therefore, under these conditions, once assembled, the blade segments will have no freedom of radial displacement with respect to the turbine disk.

Conversely, it would also be possible to provide a configuration in which when the segments are in an installed state (obtained simply by bringing the upstream and downstream ribs into their separated engagement position) the blade segments can be displaced radially in a limited manner with respect to the turbine disk, and can still be retained in the external radial direction by means of various engagement means. In this manner, particularly when the wheel is no longer rotating, the upstream and downstream engagement means of some blade segments do not cooperate with complementary upstream and downstream engagement means of the turbine disk, due to gravity such that these segments concerned are stopped in the inwards radial direction in contact with the turbine disk, therefore opposite the position in which they are retained in the outwards radial direction by the same turbine disk. Thus, in this configuration, it is only when the wheel is rotating that the centrifugal force generated causes engagement and then cooperation between the upstream and downstream engagement means of all blade segments, and complementary upstream and downstream engagement means of the turbine disk. Under these dynamic conditions, these complementary upstream and downstream engagement means of the turbine disk will effectively act as an external radial stop for the upstream and downstream engagement means of the blade segments.

In the second case in which the segments are assembled not only by bringing the upstream and downstream ribs into their separated engagement position, but also by performing supplementary operations with the purpose of obtaining permanent cooperation between the upstream and downstream engagement means of all blade segments and complementary upstream and downstream engagement means of the turbine disk, as will be presented in detail below.

Thus, regardless of the configuration adopted for the turbine wheel according to the invention, the turbine wheel generates almost no restriction about the maximum number of blades to be provided on each segment. Consequently, this considerably reduces the number of these blade segments, and therefore also the number of spaces to be sealed between two directly consecutive blade segments, compared with the number used in the embodiments according to prior art. Therefore, global sealing of the turbine wheel is naturally significantly improved.

Furthermore, the possibility of reducing the number of segments by providing several blades on each segment causes a significant reduction in production and assembly costs.

Finally, note that the fact of providing firstly cooperation between the upstream engagement means and the complementary upstream engagement means, and secondly between the downstream engagement means and the complementary downstream engagement means, provides a means of procuring perfectly satisfactory upstream and downstream seals between the turbine disk and the blade segments, such that it is then no longer necessary to design the upstream labyrinth to supply cooling air to the blades.

Obviously, the fact that the upstream labyrinth is no longer required can also significantly reduce production cost of the turbine wheel.

Preferably, each of the upstream and downstream ribs of the turbine disk is elastic. In this way, by designing the turbine wheel such that the separated engagement position of these ribs correspond to a rest position, it is then easily possible to bring these ribs from the separated engagement position to the close position simply by applying a force to these ribs, to deform them. Moreover, as already mentioned, the return to the separated engagement position then takes place automatically by releasing the force applied, due to the elasticity of these ribs.

Obviously, it would also be possible to plan to apply a force to only one of the two upstream and downstream ribs to make it deform following application of the force required to reach the close position without going outside the context of the invention.

Preferably, the complementary upstream and downstream engagement means extend in an annular arrangement around the main longitudinal axis of the wheel, and the upstream and downstream engagement means of each blade segment root are made so that each forms an annular portion of the same axis, extending circumferentially around the entire blade segment root. Consequently, due to the large cooperation length between the various engagement means in the circumferential direction, it is possible to obtain effective mechanical support for blade segments easily resisting radial forces generated during rotation of the turbine wheel. This arrangement also provides a very satisfactory seal between firstly blade segments and secondly the turbine disk.

Preferably, the complementary upstream and downstream engagement means and the upstream and downstream engagement means of the root of each blade segment each have a hook-shaped longitudinal section that is quite suitable to block them in the external radial direction.

It is then possible to arrange the design such that the complementary upstream engagement means have a hook-shaped longitudinal section projecting in the upstream direction and defining an engagement opening oriented approximately in the inwards radial direction, and that the upstream engagement means have a hook-shaped longitudinal section projecting in the downstream direction and defining an engagement opening oriented approximately radially outwards, that the complementary downstream engagement means have a hook-shaped longitudinal section projecting towards the downstream direction and defining an engagement opening oriented in approximately the inwards radial direction, and finally the downstream engagement means have a hook-shaped longitudinal section projecting in the upstream direction and defining an engagement opening oriented approximately in the outwards radial direction.

Under these conditions, once the segments have been put into place and the upstream and downstream ribs have once again be brought into their separated engagement position, this preferred solution can give an engagement and then a cooperation between the various engagement means simply by making a relative radial movement between each of the blade segments and the turbine disk. Naturally and preferably, the radial relative movement for each blade segment is made by moving this segment in the outwards radial direction while holding the disk fixed.

Still preferably, each blade segment also comprises holding means for maintaining permanent cooperation between the upstream and downstream engagement means of the blade segment installed on the turbine disk, and the corresponding complementary upstream and downstream engagement means of this turbine disk, when they cooperate with the turbine disk. In this way, permanent cooperation between the various engagement means advantageously provides the means of holding the blade segments fixed with respect to the turbine disk and therefore obtaining precise radial and circumferential indexing of each of these blade segments with respect to the turbine disk.

To achieve this, it would be possible for holding means to comprise at least one flexible strip forming part of the root, a free end of the blade being designed to bear on the turbine disk, each of these flexible strips then being in contact on the disk only after the upstream and downstream ribs have been brought into their separated engagement position, and the corresponding blade segment having been forced radially outwards to bear on the complementary engagement means on the disk.

Preferably, the upstream and downstream ribs of the turbine disk define an annular space between them arranged around the main longitudinal axis of the wheel, this annular space communicating with cooling passages provided on the roots of the blade segments. Moreover, the upstream rib of the turbine disk has at least one injection hole passing through it and opening up inside the annular space, each injection hole being designed to cooperate with a cooling air injector of the turbomachine.

Also preferably, the turbine disk is a single-piece.

Another object of the invention is an assembly method for a turbine wheel like that described above and also subject of this invention, this method comprising the following successive steps consisting of:

bringing the upstream and downstream ribs of the turbine disk into the close position;

positioning each blade segment with respect to the turbine disk such that when the upstream and downstream ribs of the turbine disk are once again brought into their separated engagement position, the upstream and downstream engagement means of the root of each blade segment are capable of engaging with the complementary upstream and downstream engagement means of the turbine disk; and bringing the upstream and downstream ribs of the turbine disk into their separated engagement position.

The steps consisting of bringing the upstream and downstream ribs of the turbine disk into the close position and bringing the upstream and downstream ribs of the turbine disk into their separated engagement position are made by applying pressure on the upstream and downstream ribs using an appropriate tool, and releasing the applied pressure, respectively.

Naturally, as mentioned above, in the step consisting of positioning each blade segment with respect to the turbine disk, it should be understood that the various engagement means must be capable of engaging either directly during the step in which the upstream and downstream ribs are brought into their separated engagement position, or following rotation of the wheel, or following the execution of later operations as will be described more precisely below.

Other advantages and characteristics of the invention will become clear after reading the detailed non-limitative description given below.

BRIEF DESCRIPTION OF THE DRAWINGS

This description will be made with reference to the attached drawings among which.

DETAILED PRESENTATION OF PREFERRED EMBODIMENTS

Figure 1:
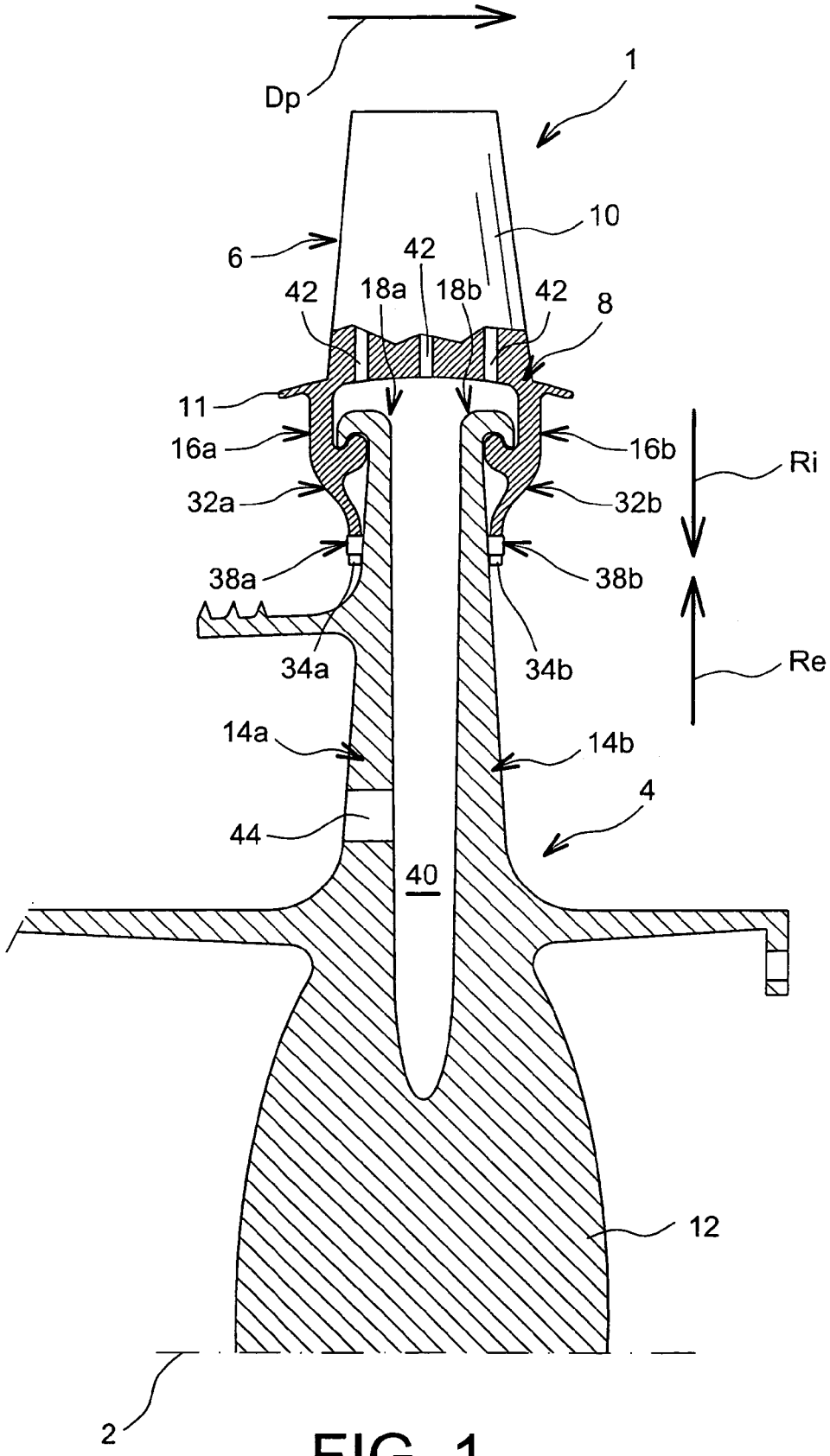
FIG. 1 shows a longitudinal half-sectional view of a turbine wheel according to a first preferred embodiment of this invention, this turbine wheel being shown in the installed state.
Figure 2:
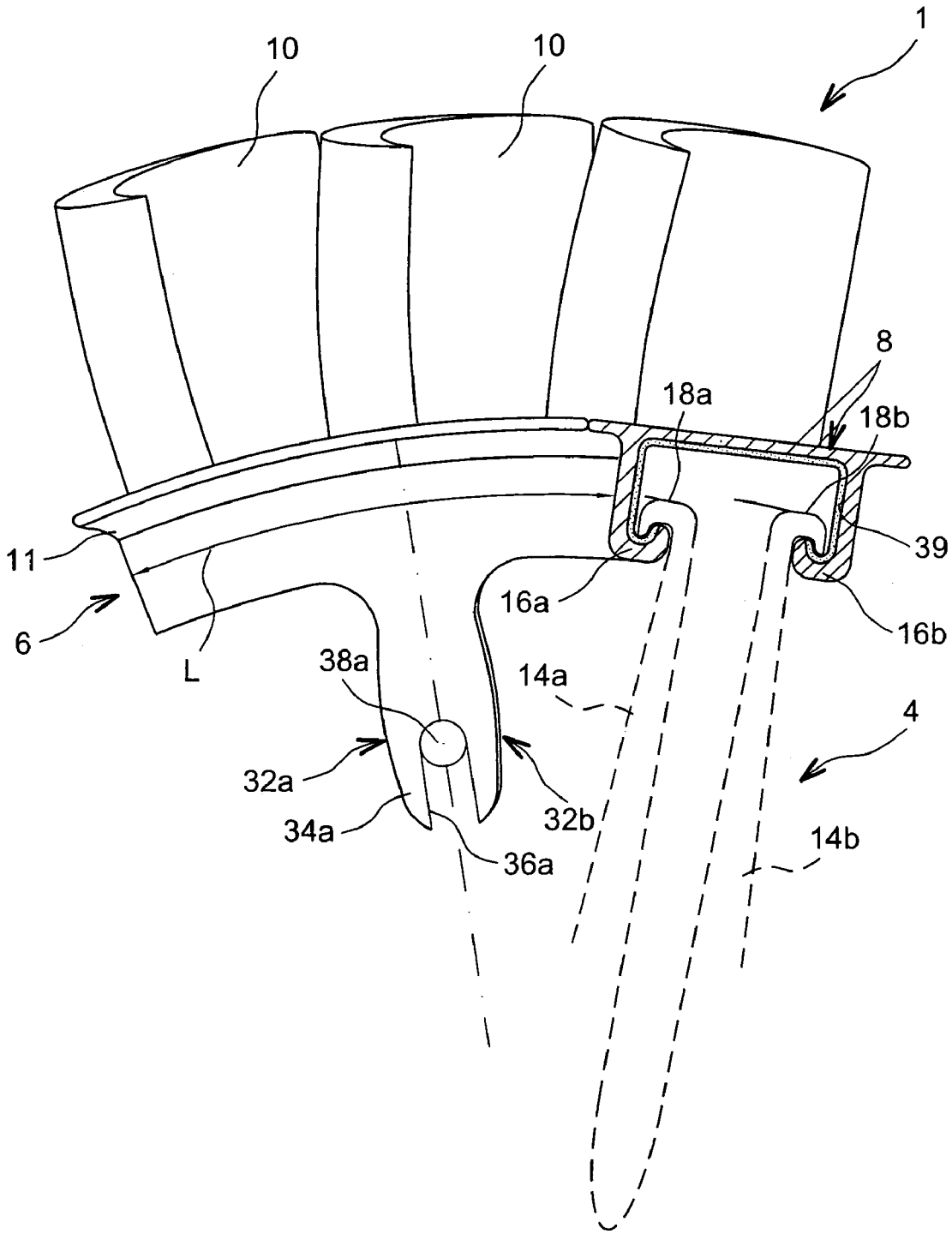
FIG. 2 shows a partial perspective view of the turbine wheel represented in FIG. 1.

A turbine wheel 1 for a turbine machine according to a first preferred embodiment of this invention is shown with reference jointly to FIGS. 1 and 2.

The turbine wheel 1, with a longitudinal principal axis 2, comprises a turbine disk 4, preferably single-piece, and several blade segments 6 installed on the disk 4, only one of these segments 6 being shown in FIG. 2.

Each blade segment 6 comprises a root 8 prolonged in the radial direction outwards by a blade 10, or preferably by several blades 10. For example, each segment 6 is provided with three blades 10 fixed to an external radial part 11 of the root 8, for example this part 11 of the metallic plate type possibly with a variable thickness may be approximately in the shape of an angular sector of a cylindrical geometry with an axis identical to the longitudinal principal axis 2. Furthermore, the turbine wheel may be designed so as to have about twenty segments 6 of three blades 10, these segments 6 being uniformly distributed about the longitudinal principal axis 2 and mounted on the turbine disk 4. Furthermore, each space (not shown) between two directly consecutive segments 6 is conventionally sealed using means known to those skilled in the art.

The turbine disk 4 comprises an internal body 12, preferably of the solid body type, or more conventionally a body through which a central hole is perforated if necessary, for example to allow a low pressure turbine shaft to pass through, this internal body 12 being centred on the longitudinal principal axis 2. The internal body 12 is prolonged in the outwards radial direction firstly by an upstream rib 14*a* and secondly by a downstream rib 14*b*. As can be seen clearly in FIG. 1, the upstream rib 14*a* and the downstream rib 14*b* each extends approximately in an annular manner around the longitudinal principal axis 2 of the wheel 1, and each extend in the radial direction as far as a radial end of the disk 4.

Naturally, throughout this entire description, the terms <<upstream>> and <<downstream>> are defined with respect to a principal gas flow direction through the turbine wheel 1, this direction being schematically represented by the arrow Dp in FIG. 1.

Preferably, the upstream rib 14*a* and downstream rib 14*b* are both elastic, so that they can be easily moved from a separated engagement position like that shown in FIGS. 1 and 2, to a close position, and vice versa. This specific feature makes it possible to install blade segments 6 on the single-piece disk 4, as will be described in more detail later.

In the installed state shown in FIGS. 1 and 2, the blade segments 6 are not only retained in an external radial direction indicated diagrammatically by the arrow Re, but are also retained in an internal radial direction indicated schematically by the arrow Ri. In this way, as will become clear in the remainder of this description, the specific nature of this first preferred embodiment of this invention lies in the fact that the blade segments 6 have no freedom for radial displacement with respect to the turbine disk 4.

To maintain the blade segments 6 in the external radial direction Re by the turbine disk 4, each segment 6 comprises upstream engagement means 16*a* and downstream engagement means 16*b*, which extend radially inwards from part 11 of the root 8, to which they are rigidly fixed. These upstream engagement means 16*a* and downstream engagement means 16*b* cooperate with complementary upstream engagement means 18*a* forming an external radial end of the upstream rib 14*a*, and with complementary downstream engagement means 18*b* forming an external radial end of the downstream rib 14*b*. Obviously, the term <<cooperate>> means that the various engagement means 16*a*, 16*b*, 18*a* and 18*b* actually retain each segment 6 in the outwards radial direction Re with respect to disk 4. Consequently, in the installed state in which the various engagement means 16*a*, 16*b*, 18*a* and 18*b* cooperate with each other, the blade segments 6 are at the outer radial limit stop in contact with the turbine disk 4, and therefore these segments 6 cannot move in the outwards radial direction Re with respect to this same disk 4.

Figure 3:
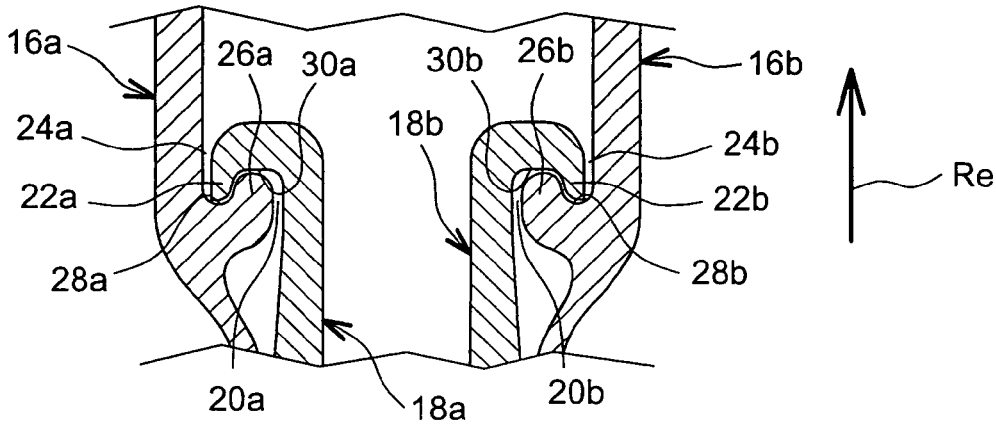
FIG. 3 shows an enlarged partial view of FIG. 1.

FIG. 3, shows the various engagement means 16*a*, 16*b*, 18*a* and 18*b* in more detail, when they cooperate with each other.

In this first preferred embodiment of this invention, the complementary upstream engagement means 18*a* and the complementary downstream engagement means 18*b*, and the upstream engagement mean 16*a* and the downstream engagement means 16*b* of the root 8 of each blade segment 6, have a hook-shaped longitudinal section.

More precisely, the complementary upstream engagement means 18*a* have a hook-shaped longitudinal section projecting towards the upstream direction. In other words, the complementary upstream engagement means 18*a* project in the upstream direction from the remainder of the upstream rib 14*a*. Furthermore, these means 18*a* define an engagement opening 20*a* oriented approximately in the inwards radial direction into the wheel 1, as is clearly shown in FIG. 3.

Preferably, still in a longitudinal section, the free end 22*a* of the hook points radially inwards into wheel 1.

Furthermore, the upstream engagement means 16*a* for each blade segment 6 of the wheel 1, also have a longitudinal hook-shaped section, this hook projecting towards the downstream direction. Furthermore, these means 16*a* define an engagement opening 24*a* arranged approximately in the outwards radial direction from the wheel 1. Still preferably and in the longitudinal section, the free end 26*a* of the hook points radially outwards from the wheel 1.

Thus, in the installed state corresponding to a state in which the upstream complementary engagement means 18*a* cooperate with the upstream engagement means 16*a* of each of the blade segments 6, the free end 22*a* passes through the engagement opening 24*a* and is in contact with a hook bottom 28*a* of the upstream engagement means 16*a*. Similarly, the free end 26*a* passes through the engagement opening 20*a* and is in contact with a hook bottom 30*a* of the complementary upstream engagement means 18*a*. For practical manufacturing purposes, it could be decided to prefer one of the two contacts 28*a* or 30*a*, without going outside the scope of the invention.

Consequently, the upstream complementary engagement means 18*a* preferably extending in an annular arrangement around the longitudinal principal axis 2 of the wheel 1, and the upstream engagement means 16*a* of each blade segment 6 being made so as to form an annular portion with the same axis extending circumferentially all around the root 8 over a circumferential length L, it is then possible to obtain a particularly good upstream seal. It should be noted that the centrifugal force generated during rotation of the wheel 1 causes a high pressure firstly between the free end 26*a* and the hook bottom 30*a*, and/or secondly between the free end 22*a* and the hook bottom 28*a*. In both cases, the observed support is approximately circumferential with an axis identical to the principal longitudinal axis 2, and therefore makes a large contribution to obtaining an upstream seal perfectly satisfactory for the needs encountered.

Similarly, the complementary downstream engagement means 18*b* have a hook-shaped longitudinal section projecting in the downstream direction. In other words, the complementary downstream engagement means 18*b* project in the downstream direction from the rest of the downstream rib 14*b*. Furthermore, these means 18*b* define an engagement opening 20*b* that is oriented approximately in the inwards radial direction into wheel 1, as can be clearly seen in FIG. 3.

Preferably, and still in the longitudinal section, the free end 22*b* of the hook is along the inwards radial direction into the wheel 1.

Moreover, for each blade segment 6 of the wheel 1, the downstream engagement means 16*b* also have a hook-shaped longitudinal section, the hook projecting in the upstream direction. Furthermore, these means 16*b* define an engagement opening 24*b* approximately in the outwards radial direction from the wheel 1. Also preferably and in longitudinal section, the free end 26*b* of the hook points radially outwards from the wheel 1.

Thus, in the installed state corresponding to a state in which the complementary downstream engagement means 18*b* cooperate with the downstream engagement means 16*b* of each of the blade segments 6, the free end 22*b* passes through the engagement opening 24*b* and is in contact with a hook bottom 28*b* of the downstream engagement means 16*b*. In the same way, the free end 26*b* passes through the engagement opening 20*b* and is in contact with a hook bottom 30*b* of the complementary downstream engagement means 18*b*. Once again, for practical manufacturing reasons, it could be decided to prefer one of the contacts 28*a* or 30*a*, without going outside the scope of the invention.

Consequently, the complementary downstream engagement means 18*b* also preferably extending in an annular arrangement around the longitudinal principal axis 2 of the wheel 1, and each of the downstream engagement means 16*b* of each blade segment 6 being made so as to form an annular portion with the same axis extending circumferentially along the root 8 around a circumferential length identical to the length of the upstream engagement means 16*a*, it is thus possible to obtain a particularly good downstream seal. This can still be explained due to the centrifugal force generated during rotation of the wheel 1, creating a high pressure firstly between the free end 26*b* and the hook bottom 30*b*, and secondly between the free end 22*b* and the hook bottom 28*b*.

Each of the blade segments 6 of the turbine wheel 1 is also provided with holding means 32*a* and 32*b* retaining these segments 6 in the internal radial direction Ri, to enable permanent cooperation between the various engagement means 16*a*, 16*b*, 18*a* and 18*b*, and therefore permanent contact between the free ends 22*a*, 22*b*, 26*a* and 26*b* and the hook bottoms 28*a*, 28*b*, 30*a* and 30*b* respectively.

In fact, once again with the reference to FIGS. 1 and 2, the holding means 32*a* for each segment 6 are in the form of an upstream flexible strip, extending in the inwards radial direction into wheel 1. Preferably, one end of the upstream flexible strip 32*a* is fixed to the upstream engagement means 16*a* of the segment 6, and the other end 34*a* is free and is provided with a notch 36*a*. Thus, in the installed state shown in FIGS. 1 and 2, a pin 38*a* fixed to the upstream rib 14*a* and projecting from it in the upstream direction, is inserted as far as the bottom of the notch 36*a* open in the inwards radial direction into wheel 1. Therefore, the pin 38*a* acts as an inwards radial stop for the segment 6 concerned.

Similarly, the holding means 32*b* of each segment 6 are in the form of a downstream flexible strip, this strip extending in the inwards radial direction into the wheel 1. Preferably, the downstream flexible strip 32*b* has one end fixed to the downstream engagement means 16*b* of the segment 6, and a free end 34*b* with a notch (not referenced). Thus, in the installed state, a pin 38*b* fixed to the downstream rib 14*b* and projecting from it in the downstream direction, is inserted into the bottom of the notch open in the inwards radial direction into the wheel 1. Consequently, the pin 38*b* thus also acts as an internal radial stop for the segment 6 concerned.

Preferably, and as is quite clear from the Figures, the upstream flexible strip 32*a* may be connected to the upstream engagement means 16*a*, and the downstream flexible strip 32*b* may be connected to the downstream engagement means 16*b*, at a portion of these means 16*a* and 16*b* defining the hook bottoms 28*a* and 28*b*. In other words, the junction between the flexible strips 32*a* and 32*b* and the engagement means 16*a* and 16*b* is made at a portion of these means 16*a* and 16*b* radially closest inwards into the turbine wheel 1.

In this way, when the flexible strips 32*a* and 32*b* are in place, the contact obtained between the various engagement means 16*a*, 16*b*, 18*a* and 18*b* and the contact between the free ends 34*a*, 34*b* and the pins 38*a*, 38*b*, is such that precise radial and circumferential indexing of each of the blade segments 6 with respect to the turbine disk 4 is possible.

In this first preferred embodiment, the upstream rib 14*a* and the downstream rib 14*b* define an annular space 40 arranged around the longitudinal principal axis 2, when they are in their separated engagement position. Therefore this annular space 40, open in the outwards radial direction, communicates with cooling passages 42 provided on the root 8 of blade segments 6, and more precisely on the external radial part 11 of this same root.

Furthermore, the upstream rib 14*a* is provided with at least one injection hole 44 passing through it and opening up inside the annular space 40. In this way, each injection hole 44 will cooperate with a cooling air injection system (not shown) of the turbomachine, therefore it is easy to cool the blades 10 without the need for an upstream labyrinth. Cooling air ejected from injectors can then pass through the injection holes 44, the annular space 40, then the cooling passages 42 communicating with the cooling circuit (not shown) formed inside the blades 10, in sequence.

FIGS. 6*a* to 6*d* show various steps in a method for assembling the turbine wheel 1 that has just been described, according to a preferred embodiment of this invention.

Figure 6A:
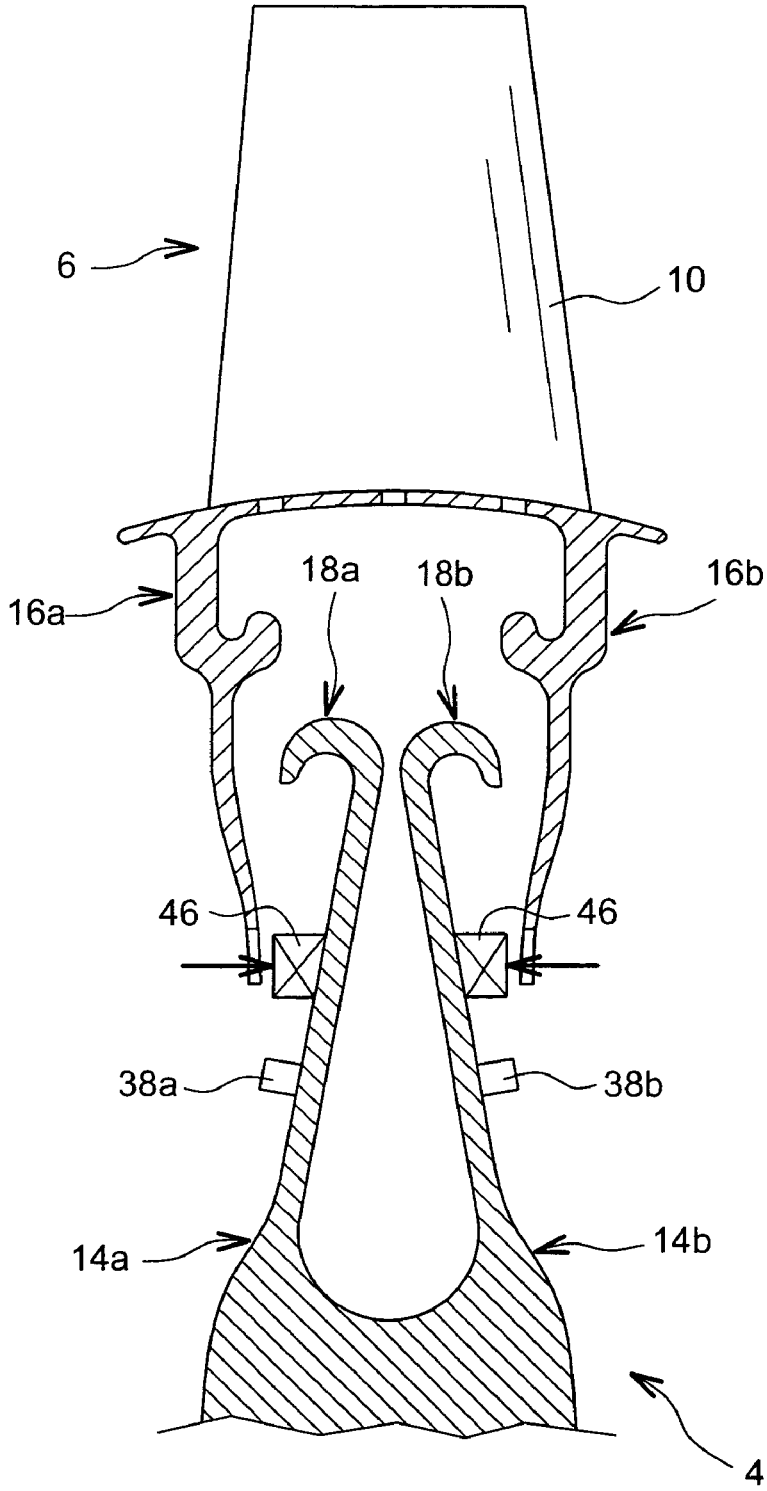
FIGS. 6*a* to 6*d* illustrate various steps in an assembly method for the turbine wheel shown in FIGS. 1 and 2, according to a preferred embodiment of this invention.

With reference firstly to FIG. 6*a*, it can be seen that a first step in this method consists of bringing the upstream rib 14*a* and the downstream rib 14*b* from the separated engagement position, into the close position. This is done using an appropriate tooling shown diagrammatically by numeric references 46, and for which the function is to apply a pressure on the upstream rib 14*a* and the downstream rib 14*b* of the single-piece disk 4, such that they deform and move close to each other. Preferably, an annular pressure is applied to the two ribs 14*a* and 14*b* around the longitudinal principal axis 2, to an upstream face of the upstream rib 14*a* and a downstream face of the downstream rib 14*b*.

The close position is obtained when the complementary upstream engagement means 18*a* and the complementary downstream engagement means 18*b* are sufficiently far from the position that they occupy when the upstream rib 14*a* and the downstream rib 14*b* are in the separated engagement position, so that segments 6 can be installed by inserting each blade segment and the turbine disk into each other.

Figure 6B:
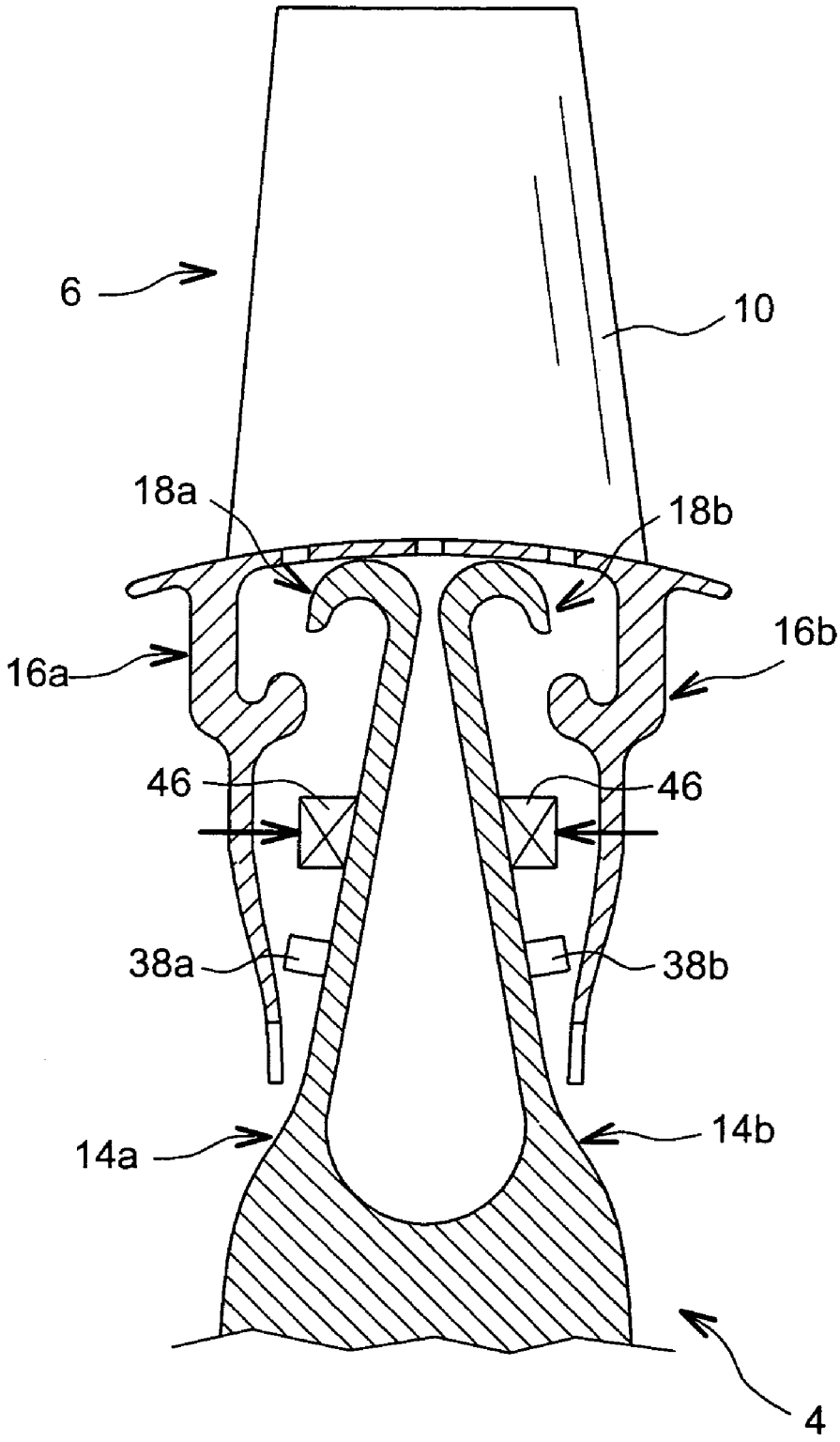

A next step consists of putting various segments 6 into place with respect to the turbine disk 4, as shown in FIG. 6*b*. Placement is done preferably by moving each of the segments 6 radially inwards into the wheel 1, such that the complementary upstream engagement means 18*a* and the complementary downstream engagement means 18*b* are inserted inside these same segments 6, without being hindered by the upstream engagement means 16*a* and the downstream engagement means 16*b*. Therefore, in this case, for each blade segment 6, the complementary engagement means 18*a* and 18*b* can be introduced into a space delimited jointly by the upstream engagement means 16*a*, the downstream engagement means 16*b*, and the external radial part 11 of the root 8 of the segment 6 concerned.

Furthermore, this placement step is only terminated when the segments 6 have been positioned sufficiently radially inwards with respect to disk 4, such that when the upstream rib 14*a* and the downstream rib 14*b* are once again brought into their separated engagement position, the upstream engagement means 16*a* and the downstream engagement means 16*b* of the root 8 of each segment 6 are capable of engaging with the corresponding complementary upstream engagement means 18*a* and complementary downstream engagement means 18*b* of the turbine disk 4, during a relative radial displacement of these various elements.

As an illustrative example, it is possible for this placement step to be completed only when the complementary engagement means 18*a* and 18*b* come into contact with the part 11 of the root 8 of each segment 8, as shown in FIG. 6*b*. In this way, the complementary engagement means 18*a* and 18*b* then act as an internal radial stop for segments 6, indicating that the blade segments 6 are actually correctly in position.

A step is then performed consisting of bringing the upstream rib 14*a* and downstream rib 14*b* into their separated engagement position, simply by releasing the pressure applied to these ribs using appropriate tooling 46.

Figure 6C:
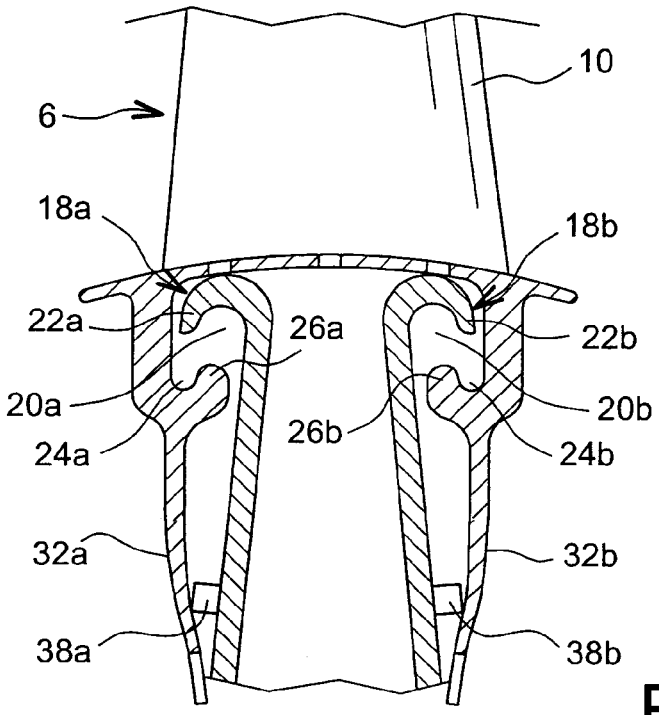

As can be seen in FIG. 6*c*, in this separated engagement position, the free ends 22*a*, 22*b*, 26*a* and 26*b* are facing the corresponding engagement openings 24*a*, 24*b*, 20*a* and 20*b* and at a distance from them, and the complementary engagement means 18*a* and 18*b* are preferably still in contact with the external radial part 11 of the roots 8. Moreover, this FIG. 6*c* also shows that the flexible strips 32*a* and 32*b* are in contact with the end of the pins 38*a* and 38*b* respectively, but these pins do not yet cooperate with the notches 36*a* due to the radial difference existing at this step in the method.

The next step in this assembly method may then consist of making a displacement of each of the blade segments 6 in the outwards radial direction Re from the disk 4, so as to make the engagement between the various engagement means 16*a*, 16*b*, 18*a* and 18*b*, in other words to insert the free ends 22*a*, 22*b*, 26*a* and 26*b* into the engagement openings 24*a*, 24*b*, 20*a* and 20*b* respectively.

Figure 6D:
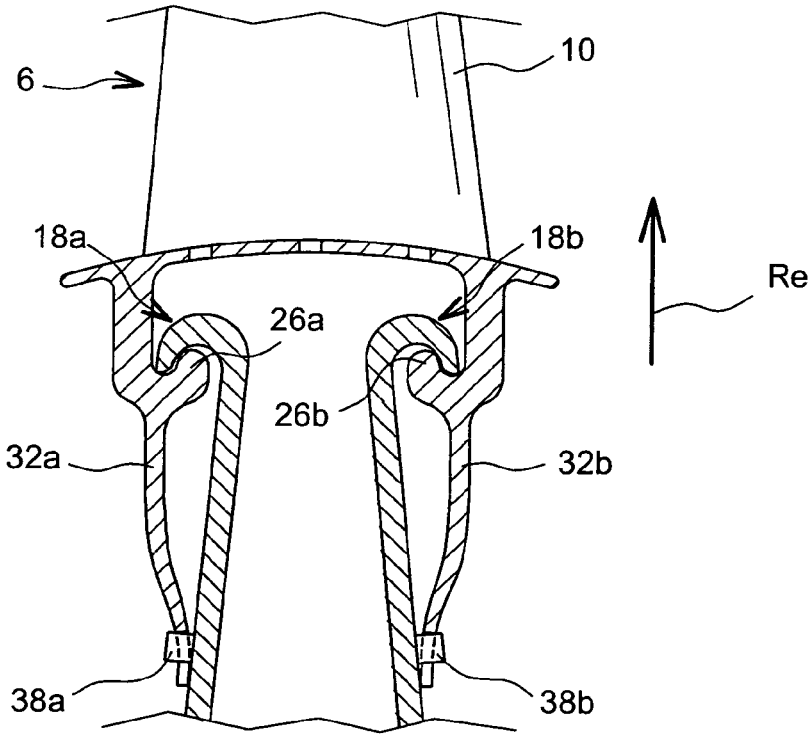

Obviously, as can be seen in FIG. 6*d*, this radial displacement is stopped by cooperation between the various engagement means 16*a*, 16*b*, 18*a* and 18*b*, namely by the free ends 22*a*, 22*b*, 26*a* and 26*b* coming into contact with the hook bottoms 28*a*, 28*b*, 30*a* and 30*b* respectively.

Finally, if each of the segments 6 has been circumferentially pre-positioned during this radial displacement operation, such that the radial direction of the flexible strips 32*a* and 32*b* coincides with the radial direction of the associated pins 38*a* and 38*b*, then at the end of the displacement, these pins 38*a* and 38*b* will automatically fit into the bottom of the notches due to the elasticity of the flexible strips 32*a* and 32*b*, as can be seen in FIG. 6*d*. Naturally, cooperation between these notches 36*a* (not shown in FIG. 6*d*) and pins 38*a* and 38*b* provides circumferential and radial indexing of segments 6, and blockage of these segments with respect to the turbine disk 4.

Note that assembly of the blade segments 6 onto the turbine disk 4 is complete at this moment. Nevertheless, the assembly method for the wheel 1 may include conventional preliminary or subsequent steps, such as steps to make various spaces formed in the blade segments 6 leak tight, for example by inserting sealing tabs 39 like those shown in FIG. 2, at the root 8 and between two consecutive blade segments 6. This step is obviously done before final indexing of these segments on the disk 4.

Figure 4:
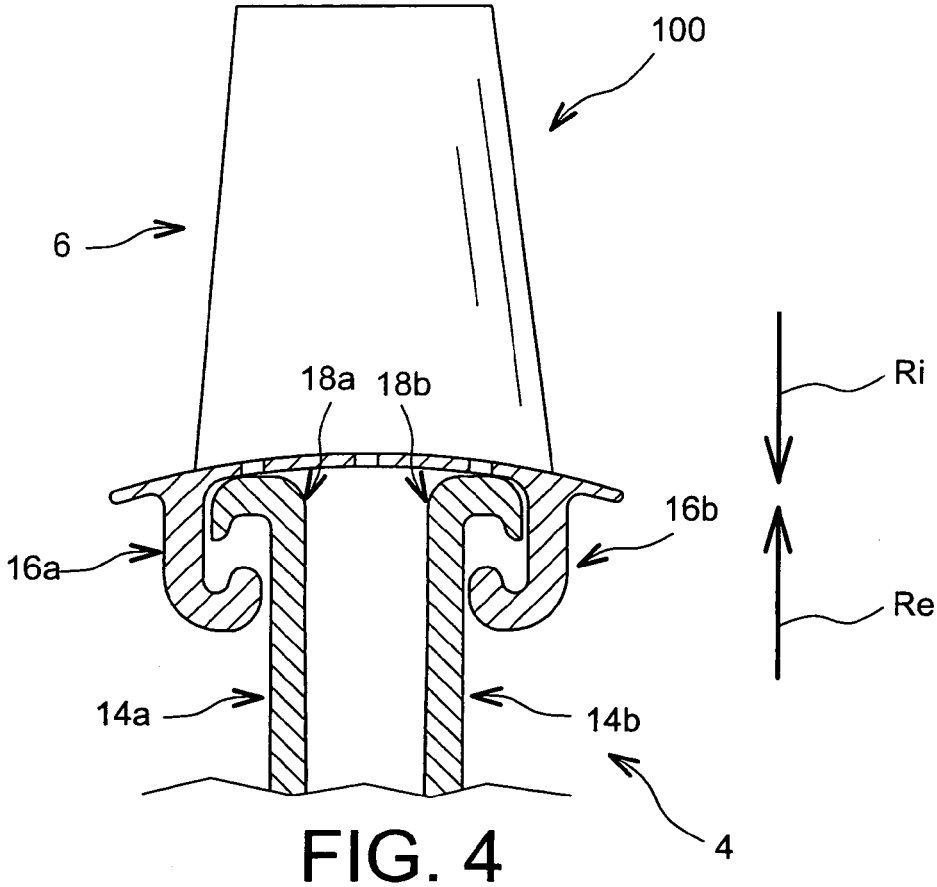
FIG. 4 shows a partial longitudinal half-sectional view of a turbine wheel according to a second preferred embodiment of this invention, this turbine wheel being shown in the installed state.
Figure 5:
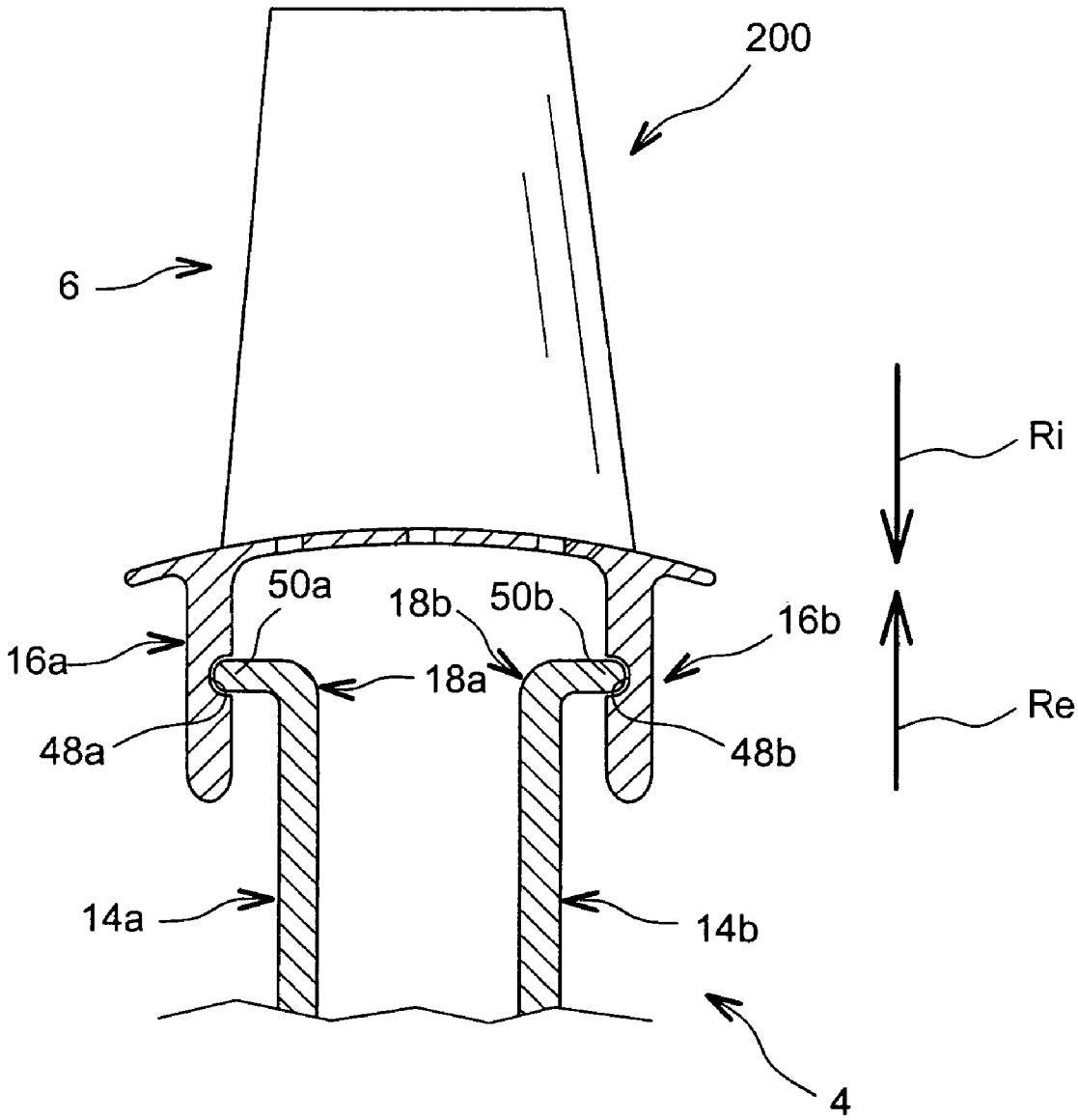
FIG. 5 shows a partial longitudinal half-sectional view of a turbine wheel according to a third preferred embodiment of this invention, this turbine wheel being shown in the installed state.

FIGS. 4 and 5 partially show second and third preferred embodiments respectively of turbine wheels 100 and 200 for a turbomachine according to this invention.

The common point between these two preferred embodiments is that assembly of the blade segments 6 onto the turbine disk 4 is complete as soon as the upstream rib 14*a* and downstream rib 14*b* have been brought into their separated engagement position, and consequently the assembly does not require any step for radial displacement of segments 6, as was described above for the first preferred embodiment. Obviously, when the upstream rib 14*a* and the downstream rib 14*b* have been put back into place in their separated engagement position, and therefore as soon as assembly of the segments 6 on the disk 4 is complete, it is naturally possible to perform conventional finishing steps such as steps designed to seal the various spaces formed between the blade segments 6.

Thus, the turbine wheel 100 according to the second preferred embodiment shown in FIG. 4 is fairly similar to the wheel 1 according to the first preferred embodiment described above. The main difference is due to the fact that the segments 6 of the wheel 100 are not provided with any holding means to obtain permanent cooperation between the various engagement means 16*a*, 16*b*, 18*a* and 18*b*, and these means are very similar to those described for the turbine wheel 1. In this manner, as can be seen clearly in FIG. 4, in the installed state and when the wheel 1 is not rotating, some segments are at the inwards radial stop in contact with complementary engagement means 18*a* and 18*b*, due to gravity. Consequently, it is only when the wheel 1 is rotating that the generated centrifugal force causes engagement and then cooperation between the upstream engagement means 16*a* and the downstream engagement means 16*b* of all the blade segments 6, and the complementary upstream engagement means 18*a* and the downstream engagement means 18*b* of the turbine disk 4.

Naturally, this solution is not as advantageous as the solution in the first preferred embodiment, to the extent that it is impossible to obtain precise radial and circumferential indexing of segments 6 with respect to disk 4.

The turbine wheel 200 according to the third preferred embodiment shown in FIG. 5 is different from the turbine wheels 1 and 100 in the sense that putting the upstream rib 14*a* and downstream rib 14*b* back into their separated engagement position simultaneously causes engagement and then cooperation between the various engagement means 16*a*, 16*b*, 18*a* and 18*b*. Furthermore, these various engagement means 16*a*, 16*b*, 18*a* and 18*b* are designed such that when they cooperate with each other, they retain segments 6 with respect to the disk 4 in the outwards radial direction Re, and in the inwards radial direction Ri. Therefore the blade segments 6 do not require any holding means like those described for the turbine wheel 1.

To achieve this, as shown in FIG. 5, the upstream engagement means 16*a* and the downstream engagement means 16*b* can each comprise an annular groove 48*a* and 48*b* open towards the downstream and upstream sides respectively. Furthermore, the complementary engagement means 18*a* and 18*b* can each be provided with an annular projection 50*a* and 50*b* projecting towards the upstream and downstream directions respectively, and with a shape complementary to the shape of the annular grooves 48*a* and 48*b* so as to be held in place correctly. Therefore with this arrangement, the engagement means 16*a*, 16*b*, 18*a* and 18*b* no longer need to have a hook-shaped longitudinal section.

Obviously, those skilled in the art could make various modifications to the turbine wheels 1, 100, 200 and to the assembly method that have just been described solely as non-limitative examples.

The invention claimed is:

1. A turbine wheel for a turbomachine comprising:

a turbine disk and several blade segments installed on the turbine disk, each blade segment comprising a root and at least one blade fixed to the root, the turbine disk comprising an upstream rib and a downstream rib each extending approximately in the annular direction around a longitudinal principal axis of the wheel and radially as far as a radial end of the disk, each blade segment installed on the turbine disk configured to be retained by the turbine disk in an external radial direction using upstream engagement means forming part of the root and configured to cooperate with complementary upstream engagement means forming an external radial end of the upstream rib, and downstream engagement means also forming part of the root and configured to cooperate with complementary downstream engagement means forming an external radial end of the downstream rib, the upstream rib and downstream rib of the turbine disk being configured to be moved from a separated engagement position to a close position, and vice versa, so that each blade segment is configured to be assembled on the turbine disks, wherein at least one of the upstream rib and the downstream rib is elastic such that the at least one rib is configured to be moved from the separated position to the close position and from the close position to the separated position by respectively applying a pressure on the at least one rib, and releasing the applied pressure.

2. The turbine wheel according to claim 1, wherein each of the upstream rib and downstream rib of the turbine disk is elastic.

3. The turbine wheel according to claim 1, wherein the complementary upstream and downstream engagement means extend in an annular arrangement around a main longitudinal axis of the wheel, and the upstream and downstream engagement means of each root of the blades segment are made so that each forms an annular portion of the same axis, extending circumferentially around the entire root of the blade segment.

4. The turbine wheel according to claim 1, wherein each blade segment comprises holding means for maintaining permanent cooperation between the upstream and downstream engagement means of the blade segment installed on the turbine disk, and the corresponding complementary upstream and downstream engagement means of this turbine disk when they cooperate with the turbine disk.

5. A turbine wheel according to claim 4, wherein for each blade segment, the holding means comprise at least one flexible strip forming part of the root and for which a free end is designed to bear on the turbine disk.

6. The turbine wheel according to claim 1, wherein the upstream rib and the downstream rib of the turbine disk define an annular space between them arranged around the main longitudinal axis of the wheel, the annular space communicating with cooling passages provided on the roots of the blade segments.

7. The turbine wheel according to claim 6, wherein the upstream rib of the turbine disk has at least one injection hole passing through it and opening up inside the annular space, each injection hole being configured to cooperate with a cooling air injector of the turbomachine.

8. The turbine wheel according to claim 1, wherein each blade segment of the wheel comprises at least two blades fixed to the root.

9. The turbine wheel according to claim 1, wherein the disk is single-piece.

10. The turbine wheel according to claim 1, wherein the upstream rib and downstream rib, in an undeformed state, are farther from each other than when in a deformed state.

11. A turbine wheel for a turbomachine comprising:

a turbine disk and several blade segments installed on the turbine disk, each blade segment comprising a root and at least one blade fixed to the root, the turbine disk comprising an upstream rib and a downstream rib each extending approximately in the annular direction around a longitudinal principal axis of the wheel and radially as far as a radial end of the disk, each blade segment installed on the turbine disk configured to be retained by the turbine disk in an external radial direction using upstream engagement means forming part of the root and configured to cooperate with complementary upstream engagement means forming an external radial end of the upstream rib, and downstream engagement means also forming part of the root and configured to cooperate with complementary downstream engagement means forming an external radial end of the downstream rib, the upstream rib and downstream rib of the turbine disk being configured to be moved from a separated engagement position to a close position, and vice versa, so that each blade segment is configured to be assembled on the turbine disk, wherein at least one of the upstream rib and the downstream rib is elastic such that the at least one rib is configured to be moved from the separated position to the close position and from the close position to the separated position by respectively applying a pressure on the at least one rib, and releasing the applied pressure, and wherein the complementary upstream and downstream engagement means, and the upstream and downstream engagement means of the root of each blade segment have a hook-shaped longitudinal section.

12. The turbine wheel according to claim 11, wherein the complementary upstream engagement means have a hook-shaped longitudinal section projecting in the upstream direction and defining an engagement opening oriented approximately in the inwards radial direction into the wheel, the upstream engagement means have a hook-shaped longitudinal section projecting in the downstream direction and defining an engagement opening oriented approximately radially outwards from the wheel, the complementary downstream engagement means have a hook-shaped longitudinal section projecting towards the downstream direction and defining an engagement opening oriented in approximately the inwards radial direction of the wheel, and the downstream engagement means have a hook-shaped longitudinal section projecting in the upstream direction and defining an engagement opening oriented approximately in the outwards radial direction from the wheel.

13. The turbine wheel according to claim 11, wherein each of the upstream rib and downstream rib of the turbine disk is elastic.

14. The turbine wheel according to claim 11, wherein the complementary upstream and downstream engagement means extend in an annular arrangement around a main longitudinal axis of the wheel, and the upstream and downstream engagement means of each root of the blades segment are made so that each forms an annular portion of the same axis, extending circumferentially around the entire root of the blade segment.

15. The turbine wheel according to claim 11, wherein each blade segment comprises holding means for maintaining permanent cooperation between the upstream and downstream engagement means of the blade segment installed on the turbine disk, and the corresponding complementary upstream and downstream engagement means of this turbine disk when they cooperate with the turbine disk.

16. A turbine wheel according to claim 15, wherein for each blade segment, the holding means comprise at least one flexible strip forming part of the root and for which a free end is designed to bear on the turbine disk.

17. The turbine wheel according to claim 11, wherein the upstream rib and the downstream rib of the turbine disk define an annular space between them arranged around the main longitudinal axis of the wheel, the annular space communicating with cooling passages provided on the roots of the blade segments.

18. The turbine wheel according to claim 17, wherein the upstream rib of the turbine disk has at least one injection hole passing through it and opening up inside the annular space, each injection hole being configured to cooperate with a cooling air injector of the turbomachine.

19. The turbine wheel according to claim 11, wherein each blade segment of the wheel comprises at least two blades fixed to the root.

20. The turbine wheel according to claim 11, wherein the disk is single-piece.

21. Method for installing a turbine wheel according to any one of the previous claims, comprising the following successive steps of:

bringing the upstream rib and the downstream rib of the turbine disk into the close position;

positioning each blade segment with respect to the turbine disk such that when the upstream rib and the downstream rib of the turbine disk are once again brought into their separated engagement position, the upstream and downstream engagement means of the root of each blade segment engage with the complementary upstream and downstream engagement means of the turbine disk; and bringing the upstream rib and the downstream rib of the turbine disk into their separated engagement position, the steps including bringing the upstream rib and the downstream rib of the turbine disk into the close position and bringing the upstream rib and the downstream rib of the turbine disk into their separated engagement position being made by applying pressure on the upstream rib and the downstream rib using an appropriate tool, and releasing the applied pressure, respectively.

22. A turbine comprising:

a turbine disk and several blade segments installed on the turbine disk, each blade segment including a root and at least one blade fixed to the root, the turbine disk including an upstream rib and a downstream rib each extending approximately in the annular direction around a longitudinal principal axis of the wheel and radially as far as a radial end of the disk, each blade segment installed on the turbine disk configured to be retained by the turbine disk in an external radial direction using upstream engagement means forming part of the root and configured to cooperate with complementary upstream engagement means forming an external radial end of the upstream rib, and downstream engagement means also forming part of the root and configured to cooperate with complementary downstream engagement means forming an external radial end of the downstream rib, the upstream rib and downstream rib of the turbine disk being configured to be moved from a separated engagement position to a close position, and vice versa, so that each blade segment is configured to be assembled on the turbine disk, wherein at least one of the upstream rib and the downstream rib is elastic such that the at least one rib is configured to be moved from the separated position to the close position and from the close position to the separated position by respectively applying a pressure on the at least one rib, and releasing the applied pressure.

23. A turbomachine comprising:

a turbine disk and several blade segments installed on the turbine disk, each blade segment including a root and at least one blade fixed to the root, the turbine disk including an upstream rib and a downstream rib each extending approximately in the annular direction around a longitudinal principal axis of the wheel and radially as far as a radial end of the disk, each blade segment installed on the turbine disk configured to be retained by the turbine disk in an external radial direction using upstream engagement means forming part of the root and configured to cooperate with complementary upstream engagement means forming an external radial end of the upstream rib, and downstream engagement means also forming part of the root and configured to cooperate with complementary downstream engagement means forming an external radial end of the downstream rib, the upstream rib and downstream rib of the turbine disk being configured to be moved from a separated engagement position to a close position, and vice versa, so that each blade segment is configured to be assembled on the turbine disk, wherein at least one of the upstream rib and the downstream rib is elastic such that the at least one rib is configured to be moved from the separated position to the close position and from the close position to the separated position by respectively applying a pressure on the at least one rib, and releasing the applied pressure.

* * * * *